United States Patent [19]

Domian et al.

[11] Patent Number: 4,833,809

[45] Date of Patent: May 30, 1989

[54] FIREARM HAMMER CONSTRUCTION

[75] Inventors: Robert E. Domian, Somers, Conn.; Robert W. MacWilliams, Ludlow, Mass.

[73] Assignee: Dan Wesson Arms, Inc., Monson, Mass.

[21] Appl. No.: 63,485

[22] Filed: Jun. 18, 1987

[51] Int. Cl.[4] ..... F41C 1/00

[52] U.S. Cl. ..... 42/65; 42/69.01

[58] Field of Search ..... 42/59, 65, 101, 69.01; 33/245

[56] References Cited

U.S. PATENT DOCUMENTS

| | | | |
|---|---|---|---|
| D. 138,594 | 8/1944 | Jack | 42/59 |
| 654,850 | 7/1900 | Shields | 42/65 |
| 2,270,707 | 1/1942 | Humski | 42/59 |
| 3,027,674 | 4/1962 | Mahan | 42/59 |
| 3,269,045 | 8/1966 | McGaughey | 42/65 |
| 4,001,962 | 1/1977 | Baker | 42/59 |
| 4,067,131 | 1/1978 | Ruger et al. | 42/59 |
| 4,213,263 | 7/1980 | Brouthers | 42/59 |
| 4,218,839 | 8/1980 | Brouthers | 42/65 |
| 4,219,954 | 9/1980 | Brouthers | 42/59 |
| 4,285,152 | 8/1981 | Dean | 42/59 |
| 4,531,321 | 7/1985 | Bechtel | 42/101 |
| 4,581,835 | 4/1986 | Brouthers et al. | 42/59 |
| 4,694,602 | 9/1987 | Pust | 42/59 |
| 4,742,635 | 5/1988 | Ruger et al. | 42/101 |

OTHER PUBLICATIONS

*Guns & Ammo*, "30 Years of Handguns", Sep. 88, pp. 76 and 79.

*Primary Examiner*—Deborah L. Kyle
*Assistant Examiner*—Michael J. Carone
*Attorney, Agent, or Firm*—Wolf, Greenfield & Sacks

[57] ABSTRACT

A hammer spur construction that is adapted to enable cocking of the hammer without interference of the cocking thumb with a scope mounted on the firearm. The spur top surface, in its uncocked position is disposed so that a plane or line tangent to the midpoint along the length of the spur top surface is substantially normal to the hammer striking surface.

14 Claims, 4 Drawing Sheets

FIREARM HAMMER CONSTRUCTION

BACKGROUND OF THE INVENTION

1. Field of the Invention

The present invention relates in general to firearms, and pertains, more particularly, to an improved hammer construction for a firearm.

2. Background Discussion

Hand-held revolvers are at the present time constructed so that they can accommodate a scope on the top thereof to improve the firing accuracy of the weapon. The rear of the scope typically extends to an area over the hammer of the firearm. The present constructions are such that the rear part of the scope is sufficiently close to the hammer spur so that there is not sufficient room for the thumb to engage the hammer spur in attempting to cock the hammer. To remedy this, manufacturers have employed hammer extensions. These extensions typically clamp onto the spur. The extension extends from the hammer beyond the end of the scope and thus there is then no interference with the scope. However, this requires that the extension be secured each time that the scope is used and preferably removed each time that the scope is removed. Furthermore, the extension is somewhat cumbersome and many times the extension does not hold well to the hammer. The extension tends to become loose during firing and thus this requires continuous adjustment and/or tightening of the hammer extension.

Accordingly, it is an object of the present invention to overcome the aforementioned problems associated with a hammer extension and to thus provide an improved hammer spur construction that provides sufficient clearance between the hammer spur and scope without the necessity of a hammer extension.

SUMMARY OF THE INVENTION

To accomplish the foregoing and other objects, features and advantages of the invention there is provided, in the combination, a firearm, a scope mounted on the firearm and a hammer supported in the firearm. The hammer has a striking surface that is generally arranged vertically in the firing position of the firearm and also has a spur that is adapted to enable cocking of the hammer without interference of the cocking thumb with the scope. The spur has a roughened top thumb-gripping surface and furthermore has an uncocked position and at least a partially cocked position. The spur top surface has an arcuate shape extending along a predetermined radius and also has a predetermined length. The spur top surface, in the uncocked position thereof, is disposed so that a plane tangent to the midpoint along the length of the spur top surface is substantially normal to the hammer striking surface. With this construction, as the hammer spur is rotated the spur and thumb that rotates the spur tends to move down and away from the scope. The striking surface is substantially vertical in the firing position of the firearm while the tangent plane would thus be substantially horizontal. This tangent plane is preferably in a range of +or −3° to the horizontal. The spur top surface also has a predetermined width. The predetermined width is preferably on the order of 0.39 inch while the predetermined length is preferably on the order of 0.75 inch. In comparison to prior spur constructions, the spur length is longer and in accordance with the present invention the ratio of predetermined length to predetermined width of the spur is on the order of 1.9. In order to provide the proper clearance, it is also preferred that the hammer center pivot, the center of the predetermined radius and the end of the spur all be in linear alignment.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
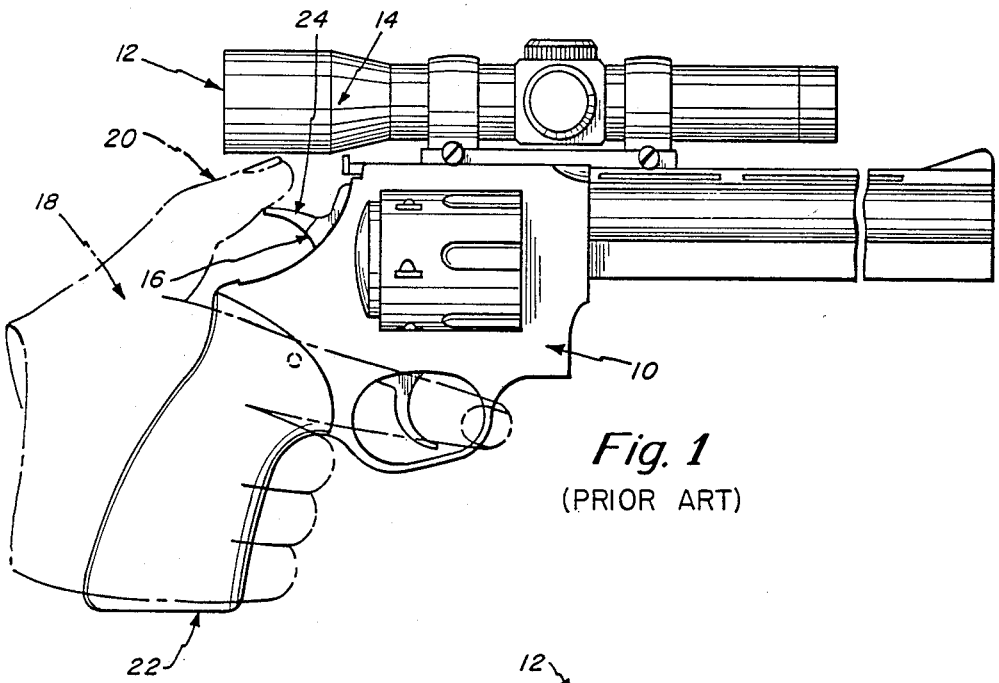
Fig. 1 (PRIOR ART)
FIG. 1 is a side elevation view of a prior art hand gun illustrating the clearance problem between the hammer spur and scope.

Reference is now made to the prior art view of FIG. 1 illustrating a handgun 10 having mounted to the top thereof a conventional scope 12. It is noted that the rear end 14 of the scope extends over the hammer of the handgun as illustrated at 16.

FIG. 1 shows the users hand at 18 in phantom outline. The hand grips the handle 22 of the firearm. FIG. 1 also shows the thumb 20 engaging with the hammer 16 at the hammer spur 24. It is noted in FIG. 1 that there is a close fit between the hammer spur 24 and the scope end 14. As illustrated in FIG. 1 the thumb 20 engages the spur 24 but the top of the thumb interferes with the scope.

Figure 2:
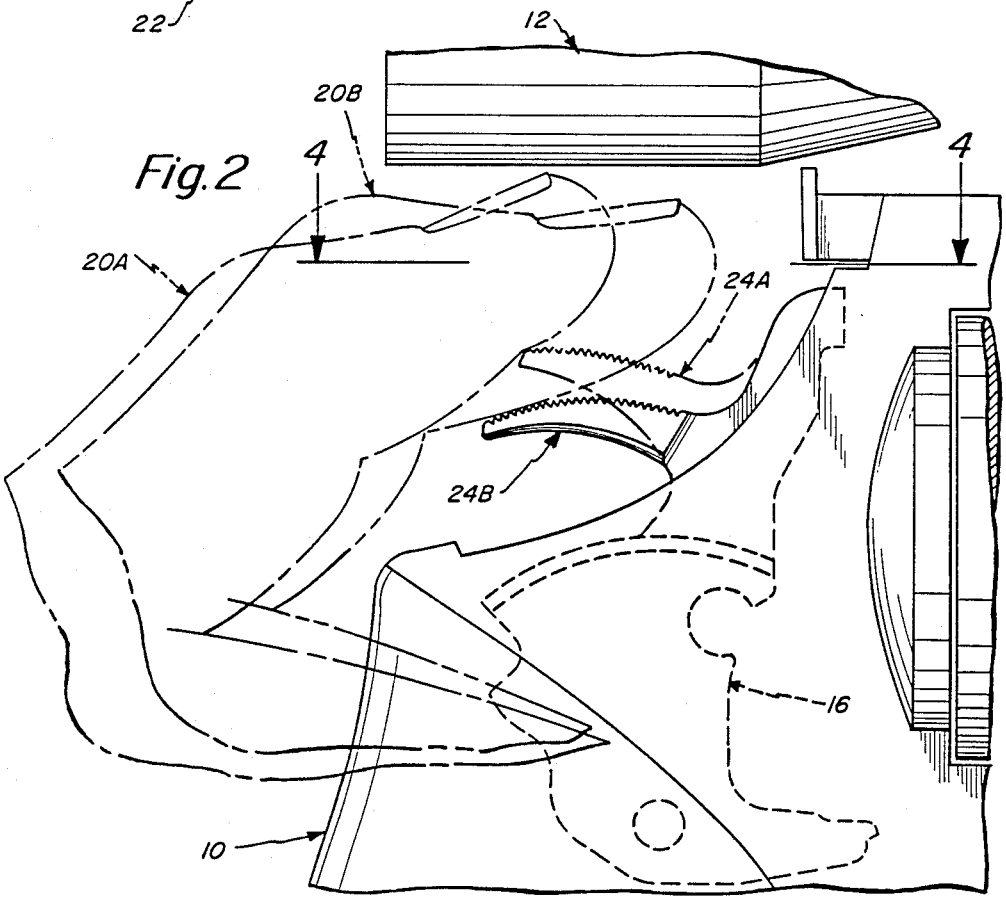
FIG. 2 is an enlarged fragmentary view illustrating both the hammer spur of the prior art as taken from FIG. 1 as well as the improved hammer spur construction of the present invention.

Reference is now made to FIG. 2. In FIG. 2 the overall hammer is illustrated in general at 16 and, for the purpose of making comparisons, the spur of the present invention and the prior art spur are both illustrated in FIG. 2. At 24A is illustrated the prior art spur. At 24B is illustrated the hammer spur in accordance with the present invention. In this regard it is noted that in connection with the engagement with the spur 24A the thumb 20A does not have sufficient clearance with respect to the scope. Furthermore, the thumb 20A engages the spur near the tip of the thumb so that even if the spur can be rotated downwardly there is limited movement of the thumb and limited contact with the spur surface.

On the other hand, with respect to the thumb 20B engaging the spur 24B, it is noted that the engagement occurs without interference with the scope and that furthermore, more of the surface area of the thumb can readily engage the spur 24B.

Figure 4:
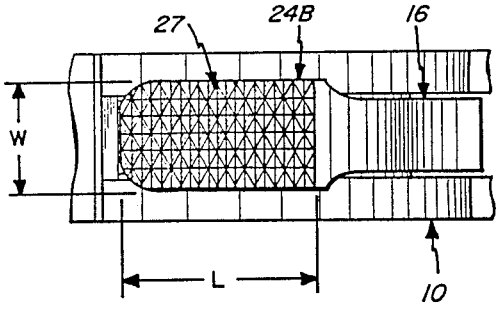
FIG. 4 is a plan view taken along line 4—4 of FIG. 2.

Reference is also now made to the plan view of FIG. 4. This illustrates the top surface 27 which is knurled or provided in some other manner with a roughened surface so that the thumb can properly grip the spur. FIG. 4 also illustrates important dimensions regarding the spur of the present invention. It is noted that the spur preferably has a width W that is on the order of 0.39 inch. Also, the spur top thumb-gripping surface 27 preferably has a length L, measured along the radius that is on the order of 0.75 inch.

Figure 3:
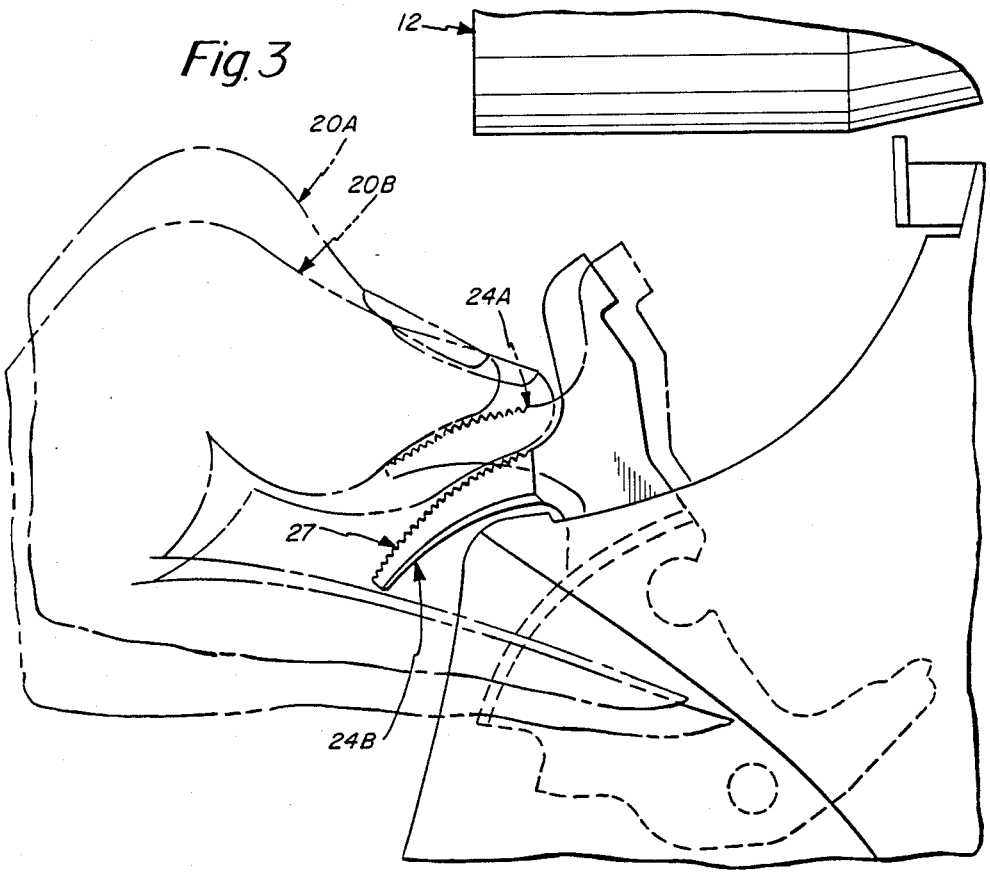
FIG. 3 is a fragmentary view similar to that of FIG. 2 and showing both the prior art spur construction as well as the spur construction of the present invention with the hammer in at least a partially cocked position.

Reference is now also made to FIG. 3 for an illustration of the hammer construction and its cocked or at least partially cocked position. Once again, there is illustrated in FIG. 3 in solid outline the hammer construction in accordance with the present invention, and in phantom outline the hammer construction of the prior art. It is noted that the thumb 20B on the spur 24B provides a maximum engagement surface between the thumb and the top thumb-gripping surface of the hammer spur. On the other hand, it is noted at 20A that the thumb is engaged primarily only at the tip with the spur 24A. It is furthermore noted that there is an extreme bend in the thumb with the old hammer construction making it quite difficult to properly cock the hammer.

Figure 5:
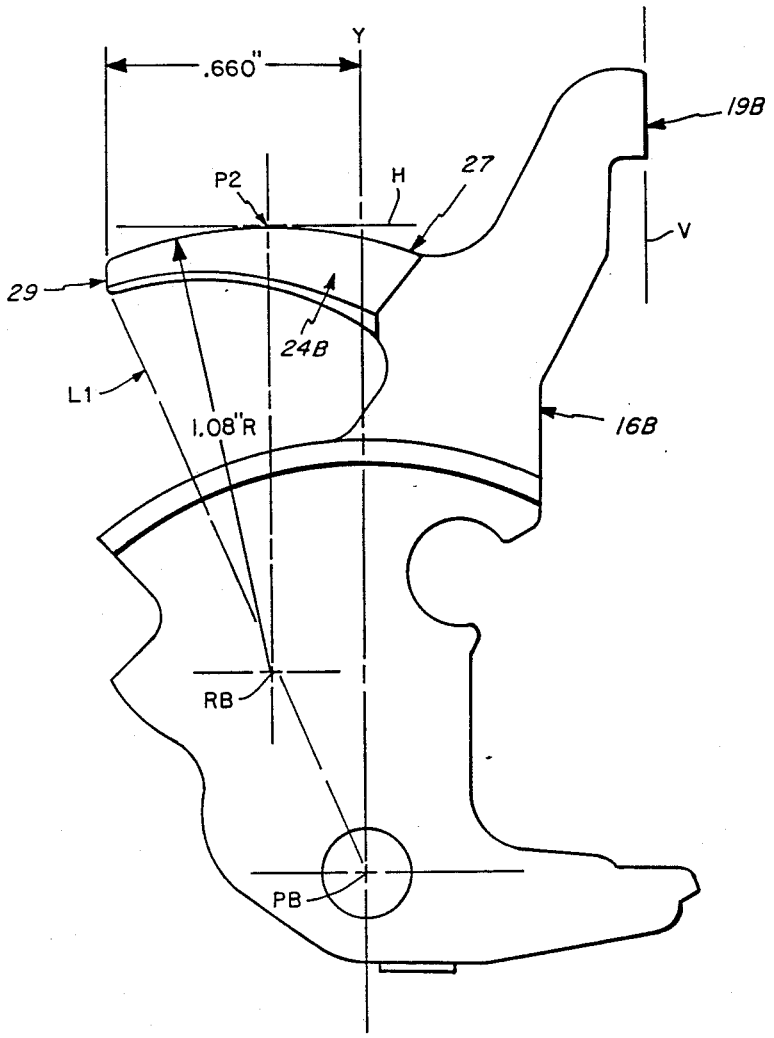
FIG. 5 is a side elevation view of the hammer construction of the present invention.
Figure 6:
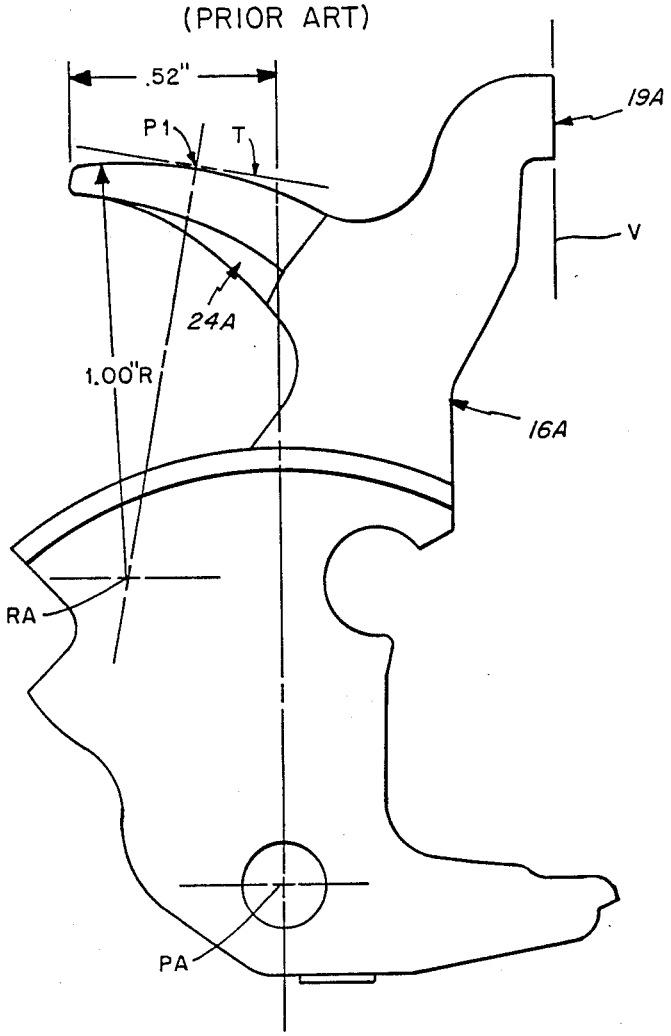
Fig. 6 (PRIOR ART)
FIG. 6 is a side elevation view of the prior art construction of the hammer.

Reference is now made to the side elevation views of FIGS. 5 and 6. FIG. 5 illustrates the hammer construction of the present invention while FIG. 6 illustrates the prior art hammer construction. In FIG. 6 it is noted that the hammer has a striking surface at 19A that extends along a substantially vertical line V. The hammer 16A also has a spur 24A having a top surface radius of curvature with this radius being measured from a center point RA. FIG. 6 also shows the pivot for the hammer at pivot point PA. Of particular interest in FIG. 6 is the fact that the tangent line T drawn along the top surface of the spur at the midpoint P1, it is noted is at an angle that is at least 10° off the horizontal. In this regard, also refer to FIG. 2 that shows a similar placement.

On the other hand, with reference to FIG. 5 and the spur construction of the present invention, it is noted that the tangent line H at the midpoint P2 along the radius curvature of the top surface of the spur, is substantially horizontal. In this connection, FIG. 5 also shows the vertical line V taken at the striking surface 19B of the hammer construction 16B. FIG. 5 also shows the lengthier surface 27 which may be all knurled as illustrated previously in, for example, FIG. 4.

Another significant dimensional consideration for providing improved clearance is the linearity of certain points as illustrated by line L1 in FIG. 5. This line illustrates the alignment of the pivot point PB, the radius center point RB and the very end 29 of the spur 24B. This alignment is also instrumental in providing the desired clearance for the improved spur construction of this invention.

It is furthermore noted, in comparing the configurations of FIGS. 5 and 6 that in the inventive configuration of FIG. 5, when the hammer is pivoted substantially all points on the hammer spur immediately move downwardly and thus away from the scope. On the other hand, in the embodiment of FIG. 6, as the hammer is rotated at least some points on the hammer spur tend to not immediately move downwardly.

In accordance with the present invention, the tangential line H illustrated in FIG. 5 may be normal to the vertical line V following the striking surface 19B. However, this relationship may vary slightly. The tangent line or tangent plane H may be in a range of +or −3° to the horizontal.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. In combination, a firearm, a scope mounted on the firearm, and a hammer supported in the firearm, said hammer having a striking surface and a spur that is adapted to enable cocking of the hammer without interference of the cocking thumb with the scope, said spur having a roughened top thumb-gripping surface, said spur having an uncocked position and at least a partially cocked position, said spur top surface having an accurate shape extending along a predetermined circumference defined by a predetermined radius and having a predetermined length measured along said predetermined circumference, said spur top surface, in the uncocked position of the spur, disposed so that a plane tangent to the midpoint along the length of the predetermined circumference is substantially normal to said hammer striking surface, said striking surface being substantially vertical in the firing position of the firearm, and said tangent plane being substantially horizontal, said tangent plane being in a range of plus or minus three degrees to the horizontal.

2. The combination of claim 1 wherein said predetermined length is on the order of 0.75 inch.

3. The combination of claim 1 wherein the hammer has a center of pivot and the center of pivot, center of predetermined radius and end of the spur are in linear alignment.

4. The combination of claim 1 wherein said spur top surface has a predetermined width.

5. The combination of claim 4 wherein the predetermined width is on the order of 0.39 inch.

6. The combination of claim 5 wherein the predetermined length is on the order of 0.75 inch.

7. The combination of claim 4 wherein the ratio of predetermined length to predetermined width is on the order of 1.9.

8. In combination, a firearm, a scope mounted on the firearm, and hammer supported in the firearm, said hammer having a striking surface and a spur that is adapted to enable cocking of the hammer without interference of the cocking thumb with the scope, said spur having a roughened top thumb-gripping surface, said spur having an uncocked position and at least a partially cocked position, said spur top surface having an arcuate shape extending along a predetermined circumference defined by a predetermined radius and having a predetermined length measured along said predetermined circumference, said spur top surface, in the uncocked position of the spur, disposed so that a plane tangent to the midpoint along the length of the predetermined circumference is substantially normal to said hammer striking surface, said spur top surface having a predetermined width, the ratio of predetermined length to predetermined width of said spur top surface being on the order of 1.9.

9. The combination of claim 8 wherein the predetermined width is on the order of 0.39 inch.

10. The combination of claim 9 wherein the predetermined length is on the order of 0.75 inch.

11. In combination, a firearm, a scope mounted on the firearm, and a hammer supported in the firearm, said hammer having a striking surface and a spur that is adapted to enable cocking of the hammer without interference of the cocking thumb with the scope, said spur having a roughened top thumb-gripping surface, said spur having an uncocked position and at least a partially cocked position, said spur top surface having an arcuate shape extending along a predetermined circumference defined by a predetermined radius and having a predetermined length measured along said predetermined circumference, said spur top surface, in the uncocked position of the spur, disposed so that a plane tangent to the midpoint along the length of the predetermined circumference is substantially normal to said hammer striking surface, said hammer having a center of pivot, said center of pivot, center of predetermined radius and free end of said spur being in linear alignment.

12. The combination of claim 11 wherein the striking surface is substantially vertical in the firing position of the firearm, and the tangent plane is substantially horizontal, the tangent plane being in a range of plus or minus three degrees to the horizontal.

13. The combination of claim 12 wherein said spur top surface has a predetermined width and wherein the ratio of predetermined length to predetermined width of the spur is on the order of 1.9.

14. In combination, a firearm, a scope mounted on the firearm, and a hammer supported in the firearm, said hammer having a striking surface and a spur that is adapted to enable cocking of the hammer without interference of the cocking thumb with the scope, said spur having a roughened top thumb-gripping surface, said spur having an uncocked position and at least a partially cocked position, said spur top surface having an arcuate shape extending along a predetermined circumference defined by a predetermined radius and having a predetermined length measured along said predetermined circumference, said spur top surface, in the uncocked position of the spur, disposed so that a plane tangent to the midpoint along the length of the predetermined circumference is substantially normal to said hammer striking surface, said striking surface being substantially vertical in the firing position of the firearm and said tangent plane being substantially horizontal, said tangent plane being no greater than about 3 degrees tilted forwardly from the horizontal.

* * * * *